United States Patent [19]

DeCaro

[11] 3,973,605

[45] Aug. 10, 1976

[54] DRIVING TOOL BARREL ASSEMBLY

[75] Inventor: Charles J. DeCaro, Marshfield, Mass.

[73] Assignee: Textron, Inc., Providence, R.I.

[22] Filed: Sept. 16, 1975

[21] Appl. No.: 613,756

[52] U.S. Cl. ..... 144/32 R; 81/54; 227/10

[51] Int. Cl.[2] ..... B25B 23/10

[58] Field of Search ..... 144/32; 81/54; 227/10

[56] References Cited

UNITED STATES PATENTS

| | | | |
|---|---|---|---|
| 1,921,485 | 8/1933 | Seger | 144/32 |
| 2,689,589 | 9/1954 | Allan et al. | 144/32 |
| 3,526,257 | 9/1970 | Kirkland | 144/32 |
| 3,869,942 | 3/1975 | DeCaro | 144/32 X |

*Primary Examiner*—Donald R. Schran

*Attorney, Agent, or Firm*—Webb, Burden, Robinson & Webb

[57] ABSTRACT

A barrel assembly for a fastener driving tool includes an outer sleeve adapted for connection to the driving tool, an inner sleeve retractably attached within the outer sleeve and a barrel pivotally and retractably connected to the inner sleeve. A breech collar is positioned in the inner sleeve and matingly engages the barrel end. Guide fingers extend through the barrel wall into the bore to position and guide the fasteners placed therein. The fasteners are inserted into the barrel bore by pivotally opening the barrel and exposing the barrel bore at the connected end of the barrel.

13 Claims, 7 Drawing Figures

DRIVING TOOL BARREL ASSEMBLY

BACKGROUND OF THE INVENTION

My invention relates to driving tools and, more particularly, to driving tools having barrel assemblies which can be loaded by pivotally opening the barrel to expose the bore thereof at its connected end.

Many driving tools have been developed for driving fasteners into workpieces. Two of the problems associated with such tools involve the loading of the tools and the aligning of the fasteners within the tools. Most tools merely are positioned over a fastener which is thereafter driven into the workpiece. The chance of misaligned and "walking" fasteners remains high with such tooling. In addition, the manual positioning of a fastener does not lend itself to an efficient and labor savings construction or industrial application. Cartridge type loading mechanisms remain complex in design and not readily amenable to wide ranges of fastener sizes.

In U.S. Pat. No. 3,688,964, I disclosed a quick opening barrel with a quick disconnect feature for a power actuated driving tool in which a driver is actuated by a caseless powder load. However, the problems presented with a standard driving tool are different since the driver must be connected to the torquing mechanism in the tool and must be extendable through the barrel so as to engage the fastener. Therefore, to use such a quick opening barrel, the driver must be out of the way in the nondriving or relaxed position. Further, if the fastener is not held by hand, it must be properly aligned so when it is engaged by the driver, it will penetrate directly and vertically into the workpiece.

SUMMARY OF THE INVENTION

I have provided a quick opening driving tool barrel assembly which is operable with a standard driving tool and driver. My assembly eliminates the misalignment of fasteners and permits rapid fastener loading and installation.

My barrel assembly includes an outer sleeve connectable to the driving tool. An inner sleeve is connected to and retractable within the outer sleeve and a barrel is pivotally connected to and retractable within the inner sleeve. The barrel is aligned through mating engagement with a breech collar positioned within the inner sleeve. The telescoping members are spring biased so as to return to an extended position. Guide fingers extend through to barrel wall so as to align the fastener within the barrel bore. The barrel bore is opened for receiving the fastener through a pivotal action about hinge pins. An end bushing is adjustably connected to the barrel to adjust for the stroke of the actual driver.

DESCRIPTION OF THE PREFERRED EMBODIMENTS

Figure 1:
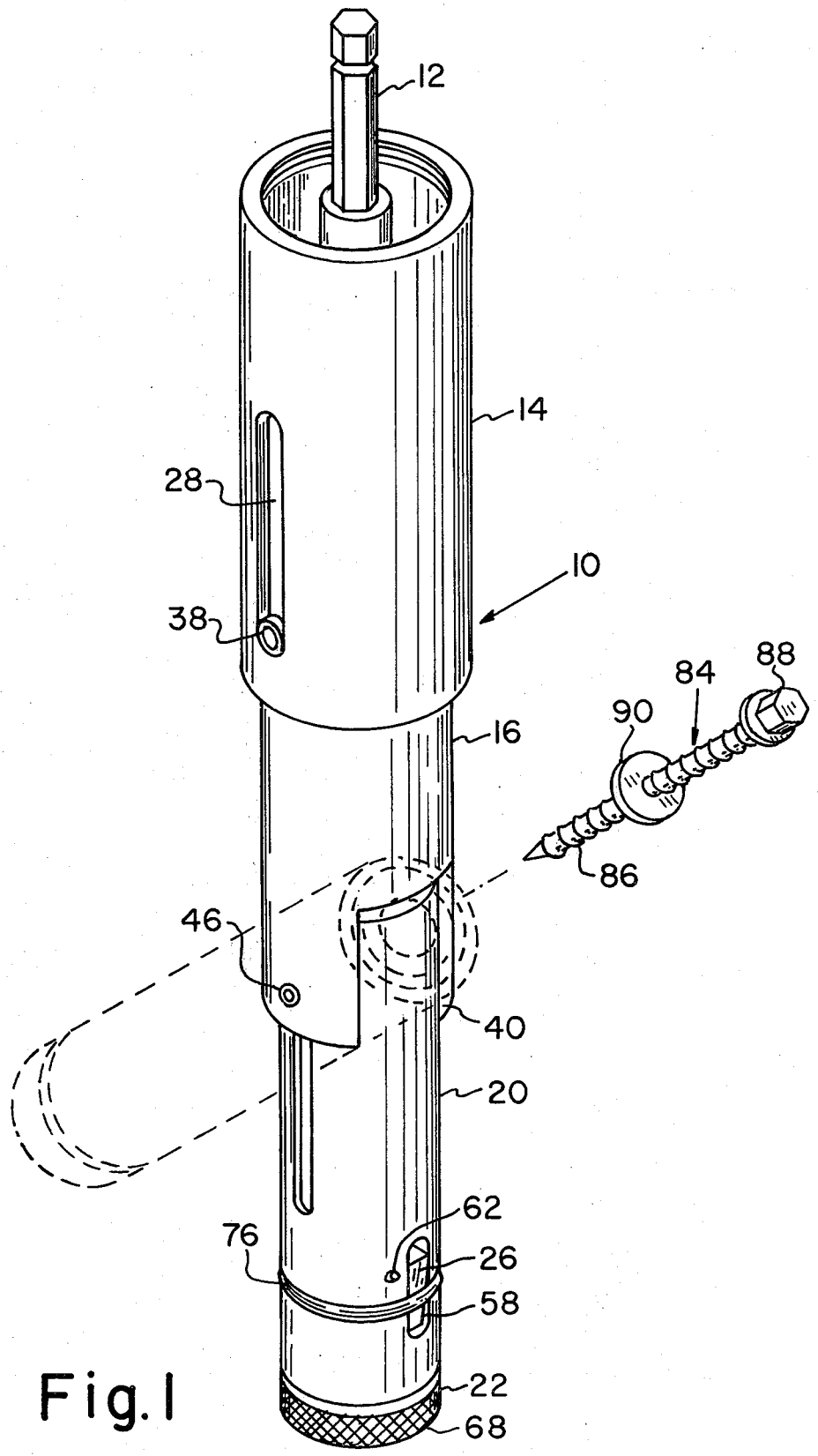
FIG. 1 is an isometric of my barrel assembly.
Figure 4:
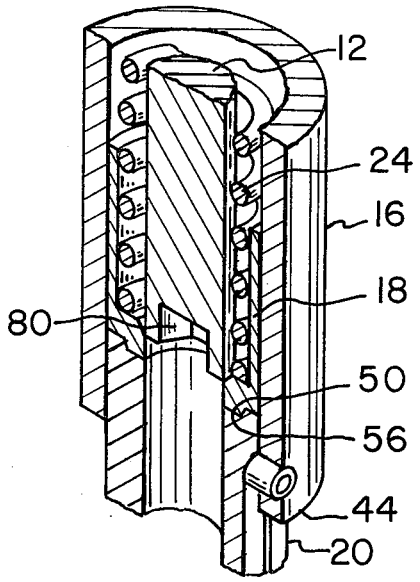
FIG. 4 is a section taken in the general area of the inner sleeve and barrel connection.

My barrel assembly, generally designated 10, is adapted for attachment to a standard driving tool (not shown) of the type used to drive fasteners into workpieces, FIG. 1. Actuation of the driving tool rotates a driver 12 which has a socket 80 for engaging the fastener 84 to screw it into a workpiece (not shown) FIGS. 4 and 5.

Figure 2:
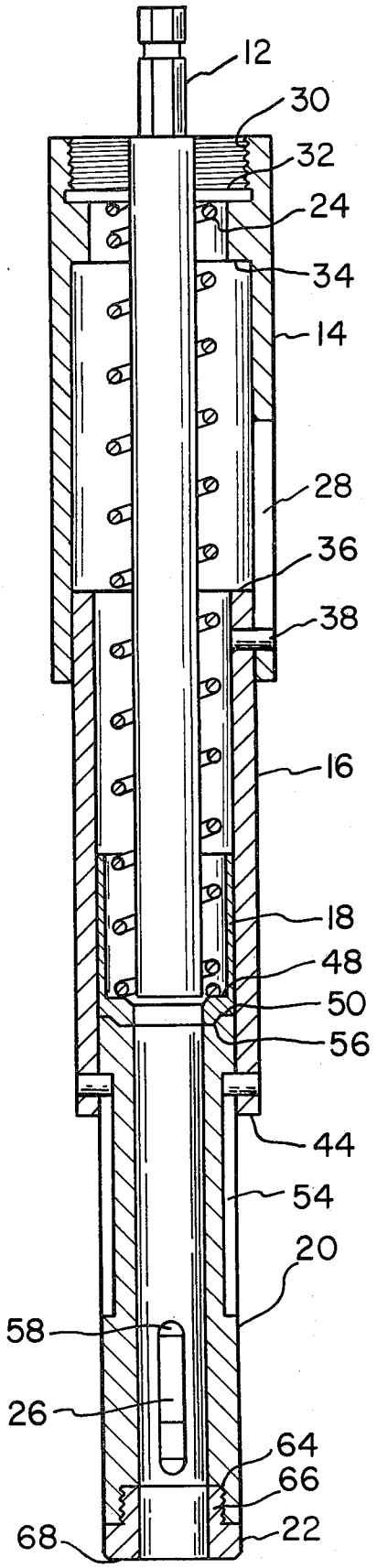
FIG. 2 is a section through my barrel assembly.
Figure 3:
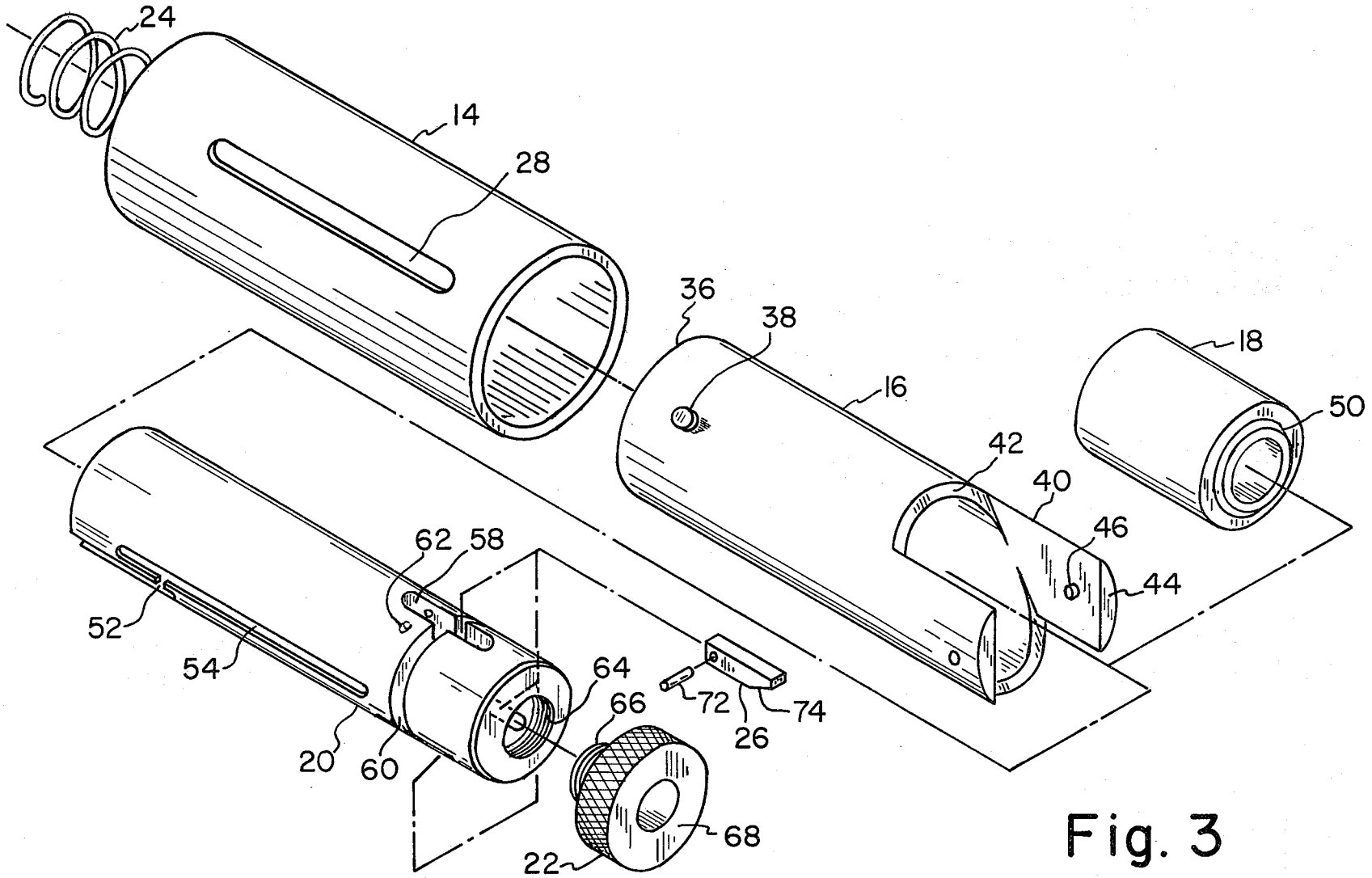
FIG. 3 is an exploded view of my barrel assembly showing the various components thereof.
Figure 7:
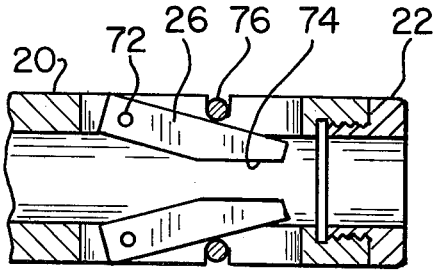
FIG. 7 is a section taken along section lines VII—VII of FIG. 6.
Figure 6:
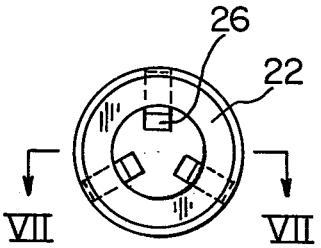
FIG. 6 is a bottom view of the barrel.

My barrel assembly 10 includes an outer sleeve 14 adapted for connection to the driving tool, FIGS. 1–3. An inner sleeve 16 attaches to and is retractable into the outer sleeve 14. A breech collar 18 is slidably positioned within the inner sleeve 16. A barrel 20 pivotally connects to the inner sleeve 16 in mating engagement with the breech collar 18. Barrel 20 is also retractable into inner sleeve 16 and is pivotally open in the same manner as a shot gun. The retractable inner sleeve 16 and retractable barrel 20 are biased in an extended position by means of a spring 24 which engages the driving tool at one end and the breech collar 18 at the other end. An adjustable end bushing 22 attaches to the barrel 20 and a plurality of locating or guide fingers 26 are positioned within slots 58 in the barrel 20. The fingers 26 extend into the barrel 20 for holding and maintaining a proper alignment of the fastener 84, FIGS. 5 and 7.

Specifically, the outer sleeve 14 has internally tapped threads 30 which terminate at an upper shoulder 32 for threadable engagement to the driving tool (not shown) FIG. 2. Outer sleeve 14 also includes a lower shoulder 34 which acts as a stop for the retractable inner sleeve 16. An elongated slot 28 extends through the wall of outer sleeve 14 to retain the inner sleeve 16 as described hereinafter, FIGS. 1 and 3. Slot 28 could also form the stop for sleeve 16.

The inner sleeve 16 is positioned partially within outer sleeve 14 and is retained within the outer sleeve 14 by means of a guide pin 38 which connects to the inner sleeve 16 and rides within the elongated slot 28, FIGS. 1 and 3. The upper surface 36 of the inner sleeve 16 engages the lower shoulder 34 of the outer sleeve 14 to limit the retractability of the inner sleeve 16, FIG. 2. The wall of the distal end of inner sleeve 16 is cut through at an angle to the bore axis so as to form opposing flanges 40 and sloped surfaces 42. These sloped surfaces 42 act as a stop to limit the extent of the opening of the barrel 20 while at the same time exposing the bore of the barrel in the open position. Opposing hinge pins 46 are connected to and extend inwardly from each of the flanges 40.

The breech collar 18 is slidably positioned within the bore of inner sleeve 16 by introducing it through the top of inner sleeve 16, FIG. 2. Hinge pins 46 act as a stop for the breech collar 18 so that breech collar 18 does not fall out of the inner sleeve 16 when the barrel 20 is opened or removed. The bore of breech collar 18 terminates in an annular inner shoulder 48 which accommodates the spring 24, FIG. 4. Breech collar 18 also terminates in an outer chamfered annular lip 50 which matingly engages the barrel 20 in the operable position of the barrel assembly 10.

The barrel 20 has bayonet slots 52 along opposing outer wall surfaces thereof to form a bayonet connection with the hinge pins 46 for connecting the barrel 20 to the inner sleeve 16, FIGS. 2 and 3. The bayonet connection formed permits rapid removal of the barrel 20. The bayonet slot 52 has an extended slot portion 54 which extends axially along the barrel 20 and which permits the barrel 20 to retract into the inner sleeve 16 as the extended slot 54 of the bayonet slot 52 rides along the hinge pins 46. The connecting end of barrel 20 includes an annular internally chamfered recess 56 which matingly engages the chamfered lip 50 of the breech collar 18 so as to maintain an axial alignment between the bores of the inner sleeve 16, the barrel 20 and the breech collar 18, FIG. 4. Three equally spaced side slots 58 extend through the wall of barrel 20 into the barrel bore near the unattached end thereof. These slots 58 accommodate the fastener locating fingers 26 as will be described hereinafter. Likewise, a groove 60 extends transversely about the barrel 20 and through the side slots 58, FIGS. 3 and 5. This groove 60 accommodates a resilient retaining ring 76 which acts to maintain the fingers 26 in the proper position. The distal end of the barrel 20 is threadably tapped to accommodate the adjusting bushing 22.

The adjustable end bushing 22 includes a threaded shank 66 for engagement with the tapped thread 64 of barrel 20, FIG. 3. End bushing 22 terminates in surface 68 which engages the workpiece.

Three fingers 26 are pivotally secured in the side slots 58 through connecting pins 72 which extend through holes 62 on either side of the side slots 58 in the barrel wall, FIGS. 3, 5–7. Retaining ring 76, which is positioned in groove 60, abuts the fingers 26 so that the sloped surfaces 74 thereof are within the bore of barrel 20 so as to properly align the fastener 84, FIGS. 5 and 7.

Figure 5:
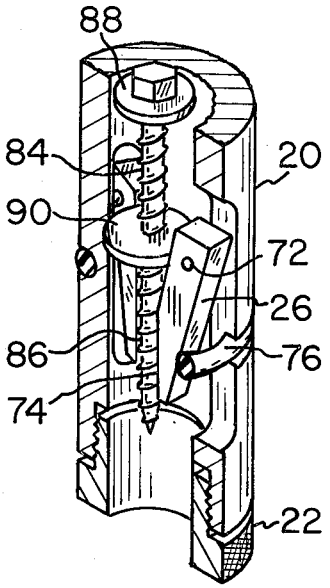
FIG. 5 is a section taken in the general area of the end of the barrel.

The fastener 84 is illustrated as having the washer 90 positioned on the shank 86 in spaced relationship to the fastener head 88, FIGS. 1 and 5. The washer 90 is so positioned so that when the fastener is inserted into the barrel 20 it will come to rest on the fingers 26 in a manner such as to prevent the point of the fastener from extending beyond the end of the bushing 22. Thus, when the fastener 84 is started in the work surface, the washer 90 will be in engagement with the fingers so as to provide better alignment and thereby start the fastener in a perpendicular relationship with the face of the workpiece. This centering effect also makes it easier for the driver socket 80, FIG. 4, to pick up the head 88 of the fastener 84. Therefore, the fingers 26 serve to hold the fastener in position for engagement by the socket 80 and then to retain and guide the fastener 84 while it is being driven. Another reason for locating the washer 90 near the point of the fastener 84 is to better center the point of the fastener to facilitate it centering itself between the fingers 26. This permits the presence of circumferential gaps between adjacent fingers 26, FIG. 6, without fear of having the point of the fastener 84 wedged between two adjacent fingers in an off-center position.

An important feature of the invention is the ability of the inner sleeve 16 to retract within outer sleeve 14. If the inner sleeve 16 and outer sleeve 14 were of a one piece construction, it would be necessary to remove the driver 12 before the barrel 20 could be opened to receive a fastener. This is true because driver 12 must be able to travel all the way to the end of barrel 20 and end bushing 22 to properly seat the fastener. With a one piece sleeve construction the driver 12 could be prevented from attaining a proper position by the fact that the bottom surface comparable to surface 44 would contact the work surface before the driver 12 could properly set the fastener. By utilizing an outer sleeve 14 and a retractable inner sleeve 16, the travel of the driver 12 is not restricted by the location of hinge pins 46 and surface 44 because as the tool is pushed down, the barrel 20 will telescope into sleeve 16 until hinge pins 46 bottom at the end of elongated slot portion 54 of the bayonet connection 52, at which point both the barrel 20 and the inner sleeve 16 will telescope into outer sleeve 14 thereby permitting the driver 12 to further enter barrel 20 until it has attained the travel necessary to properly set the fastener 84. At this point upper surface 36 of inner sleeve 16 will have contacted the lower shoulder 34 of outer sleeve 14. The telescoping action just described can actually take place simultaneously rather than as two consecutive actions as described.

Because of the tolerances of the various components and the cumulative effect of these tolerances, the adjusting end bushing 22 is provided so that the stroke of the driver 12 relative to the end of the bushing 22 can be adjusted. The bushing 22 has fine pitch threads on shank 66 so that adjustments on the order of five thousandths to one hundredths of an inch can be made. This assures that the fasteners will be properly set in the workpiece.

The loading and operation of the tool is as follows. The barrel 20 is placed in a relaxed or open position by merely rotating barrel 20 about guide pins 46, FIG. 1. This then exposes the bore of barrel 20 and a fastener 84 is merely dropped thereinto. The fastener will free fall along the bore of barrel 20 until the washer 90 engages the fingers 26. The barrel 20 is then rotated into a closed position where the internally chamfered recess 56 snaps into mating engagement with the chamfered lip 50 of the breech collar 18 which is being maintained in biased position by the spring 24. The end surface 68 of bushing 22 is positioned against the workpiece and the driving tool is pushed forward and actuated. The barrel 20 and inner sleeve 16 retract into the inner sleeve 16 and the outer sleeve 14 respectively as described hereinbefore and the socket 80 of driver 12 engages the head 88 of fastener 84 so as to drive it into the workpiece.

After the driving tool is removed from the workpiece, the spring 24 urges the telescoping components into their extended position thereby positioning driver 12 above the end of barrel 20 so as to permit barrel 20 to be opened and the sequence of operations repeated.

I claim:

1. A barrel assembly suitable for connection to a fastener driving tool having a tool body and a driver comprising:

A. an outer sleeve adapted for attachment at one end to the tool body;

B. an inner sleeve retractably mounted to the outer sleeve so as to be retractable therein;

C. a barrel retractably and pivotally connected at a first end to the inner sleeve so as to be retractable therein and moveable from a first position in axial alignment with the inner sleeve into a second position in which there is access to a barrel bore through the first end;

D. biasing means associated with the inner sleeve and the barrel to urge them into an extended position.

2. The barrel assembly of claim 1 including a breech collar positioned within the inner sleeve and in mating engagement with the first end of the barrel in the first position.

3. The barrel assembly of claim 2, said breech collar having an annular inner shoulder to accommodate the biasing means and an outer chamfered annular lip for mating engagement with an annular internally chamfered recess in the barrel first end.

4. The barrel assembly of claim 1, including guide means associated with the barrel, said guide means extending into the barrel bore to align and guide a fastener placed therein.

5. The barrel assembly of claim 4, said guide means comprising a plurality of fingers, each finger pivotally connected in slots extending through the barrel and retaining means associated with the fingers to maintain the proper alignment and guide relationship of the fingers with a fastener.

6. The barrel assembly of claim 1 including an end bushing adjustably connected to a distal end of the barrel so as to engage a workpiece and adjust the effective axial extent of the barrel and bushing relative to the driver.

7. The barrel assembly of claim 1, said outer sleeve having an elongated slot therein, said inner sleeve having a guide pin extending outwardly therefrom and extending through the elongated slot so as to be slidable therein.

8. The barrel assembly of claim 1, said outer sleeve having a tapped threaded end for attachment to the tool body and an internal annular shoulder to limit the retraction of the inner sleeve thereinto.

9. The barrel assembly of claim 1, said inner sleeve terminating in opposing flanges having hinge pins extending therefrom for connection to the barrel, a portion of the sleeve between the flanges being sloped to limit the pivotal movement of the barrel in the first position.

10. The barrel assembly of claim 9, said barrel having bayonet slots to form a bayonet connection with the hinge pins of the inner sleeve, said bayonet slots having an extended slot portion for travel along the hinge pins as the barrel is retractable into the inner sleeve.

11. A barrel assembly suitable for connection to a driving tool having a tool body and a driver comprising:

A. an outer sleeve adapted for attachment at one end to the tool body;

B. an inner sleeve retractably mounted to the outer sleeve so as to be retractable therein, said inner sleeve terminating in opposing flanges having hinge pins extending therefrom;

C. a breech collar positioned within the inner sleeve and having an annular inner shoulder and an outer chamfered lip;

D. a barrel having bayonet slots at one end for retractable and pivotal connection to said hinge pins, said slots having an extended portion for travel along the hinge pins as the barrel is retractable into the inner sleeve, said barrel pivotable from a first position in axial alignment with the inner sleeve to a second position in which there is access to a barrel bore through said one end, said barrel including an annular internally chamfered recess at said one end for mating engagement with said breech collar lip in said first position;

E. a plurality of fingers pivotally mounted in spaced relationship in slots extending through the barrel so as to extend into the barrel bore to align and guide a fastener placed therein;

F. resilient means associated with the fingers to urge said fingers into the bore; and G. spring means positioned between the driving tool and the breech collar inner shoulder to urge said sleeves and barrel into an extended position.

12. The barrel assembly of claim 11, including an end bushing threadably connected to a distal end of the barrel and adjustable to change the axial extent of the barrel and bushing.

13. The barrel assembly of claim 11, wherein said resilient means comprises a ring positioned in a transverse groove about the barrel and in abutting relationship with said fingers.

* * * * *